US008654025B1

(12) United States Patent
Brock et al.

(10) Patent No.: US 8,654,025 B1
(45) Date of Patent: Feb. 18, 2014

(54) BROADBAND, SMALL PROFILE, OMNIDIRECTIONAL ANTENNA WITH EXTENDED LOW FREQUENCY RANGE

(75) Inventors: David W. Brock, San Diego, CA (US); Hale B. Simonds, Santee, CA (US); Peter S. Berens, San Diego, CA (US); David V. Arney, El Cajon, CA (US); Robbi Mangra, San Diego, CA (US); Kelsey L. Burrell, Fullerton, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 371 days.

(21) Appl. No.: 13/086,273

(22) Filed: Apr. 13, 2011

(51) Int. Cl.
*H01Q 9/00* (2006.01)

(52) U.S. Cl.
USPC ..... 343/752; 343/773

(58) Field of Classification Search
USPC ..... 343/752, 773, 774
See application file for complete search history.

(56) References Cited

U.S. PATENT DOCUMENTS

| | | | | |
|---|---|---|---|---|
| 6,268,834 | B1 | 7/2001 | Josypenko | |
| 6,943,747 | B2 | 9/2005 | Kwon | |
| 7,864,127 | B2 * | 1/2011 | Parsche | 343/773 |
| 7,973,731 | B2 * | 7/2011 | Parsche | 343/772 |
| 2005/0140561 | A1 * | 6/2005 | Marsan et al. | 343/786 |

* cited by examiner

*Primary Examiner* — Ahshik Kim
(74) *Attorney, Agent, or Firm* — Kyle Eppele; Peter Lipovsky

(57) ABSTRACT

A compact, omnidirectional, broadband biconical antenna is described, having a first segment with its tip coincident with a horizontal plane, with an elevation angle between 23 degrees and 30 degrees from the horizontal plane; an open second segment joined to a distal end of the first segment, an elevation angle approximately 30 degrees greater than the first segment angle; an open third segment joined to a distal end of the open second segment, an elevation angle approximately 30 degrees greater than the open second segment angle; an open fourth resistive film segment joined to a distal end of the open third segment, an elevation angle approximately equal to the open third segment angle, wherein the segments are mirrored to form a biconical antenna; and a transmission line coupled to the tip of the first segment, interior to the first segment.

14 Claims, 12 Drawing Sheets

- Related Art -

BROADBAND, SMALL PROFILE, OMNIDIRECTIONAL ANTENNA WITH EXTENDED LOW FREQUENCY RANGE

FEDERALLY-SPONSORED RESEARCH AND DEVELOPMENT

This invention is assigned to the United States Government. Licensing inquiries may be directed to Office of Research and Technical Applications, Space and Naval Warfare Systems Center, Pacific, Code 72120, San Diego, Calif., 92152; telephone 619-553-2778; email: T2@spawar.navy.mil. Reference Navy Case No. 099,654.

BACKGROUND

This disclosure relates generally to the field of antennas. More particularly, this disclosure relates to compact, broadband biconical antennas.

SUMMARY

The following presents a simplified summary in order to provide a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

In one aspect of the disclosed embodiments, a compact, omnidirectional, broadband antenna with a voltage standing wave ratio (VSWR) of 2:1 or less over its design frequency range, is provided, comprising: a first conical metal segment having its tip coincident with a horizontal plane, with an elevation angle between 23 degrees and 30 degrees from the horizontal plane; an open second conical metal segment joined to a distal end of the first conical metal segment, with an elevation angle approximately 30 degrees greater than the elevation angle of the first conical metal segment; an open third conical metal segment joined to a distal end of the open second conical metal segment, with an elevation angle approximately 30 degrees greater than the elevation angle of the open second conical metal segment; at least one of a plurality of inductors or resistors, or a resistive film joined to a distal end of the open third conical metal segment; an open fourth conical metal segment joined to a distal end of the plurality of inductors or resistors, or resistive film, with an elevation angle approximately equal to the elevation angle of the open third conical metal segment angle, wherein the first, second, third, and fourth conical metal segments are mirrored to form a biconical antenna; and a transmission line coupled to the tip of the first conical metal segment, interior to the first conical metal segment.

In another aspect of the disclosed embodiments, a compact, omnidirectional, broadband antenna with a VSWR of 2:1 or less over its design frequency range is provided comprising: a first conical metal segment having its tip coincident with a horizontal plane, with an elevation angle between 23 degrees and 30 degrees from the horizontal plane; an open second conical metal segment joined to a distal end of the first conical metal segment, with an elevation angle approximately 30 degrees greater than the elevation angle of the first conical metal segment; an open third conical metal segment joined to a distal end of the open second conical metal segment, with an elevation angle approximately 30 degrees greater than the elevation angle of the open second conical metal segment; an open fourth conical resistive film segment joined to a distal end of the open third conical metal segment, with an elevation angle approximately equal to the elevation angle of the open third conical metal segment, wherein the first, second, third, and fourth conical metal segments are mirrored to form a biconical antenna; and a transmission line coupled to the tip of the first conical metal segment, interior to the first conical metal segment.

In yet another aspect of the disclosed embodiments, a method for radiating/receiving in an omnidirectional direction over a frequency range, with a VSWR of 2:1 or less, is provided, comprising: forming a first conical metal segment with its tip coincident with a horizontal plane, having an elevation angle between 22 degrees and 30 degrees from the horizontal plane; joining an open second conical metal segment to a distal end of the first conical metal segment, with an elevation angle approximately 30 degrees greater than the elevation angle of the first conical metal segment; joining an open third conical metal segment to a distal end of the open second conical metal segment, with an elevation angle approximately 30 degrees greater than the elevation angle of the open second conical metal segment; joining an open fourth conical resistive film segment to a distal end of the open third conical metal segment, with an elevation angle approximately equal to the elevation angle of the open third conical metal segment; and mirroring the first, second, third, and fourth conical metal segments to form a biconical antenna; and coupling a transmission line to the tip of the first conical metal segment, interior to the first conical metal segment; and at least one of receiving or transmitting electrical signals via the transmission line.

DETAILED DESCRIPTION

Broadband, omnidirectional antennas are highly sought for their ability to cover a wide range of frequencies. However, to design a broadband, omnidirectonal antenna is not a trivial task, usually involving complicated designs to minimize the VSWR over the desired frequency range. Further, a typical broadband antenna may not have an omnidirectional pattern at all of its frequencies, being particularly more directional at the upper and/or lower frequency ends. Moreover, it is well known that as the frequency approaches the lower ranges, the required dimensions of a broadband antenna become increasingly large, thus rendering the broadband antenna impractical in size for its mission.

In view of these challenges for a broadband antenna design, detailed below are various approaches that have been devised by the inventors to improve upon one form of a broadband, omnidirectional antenna—the bicone antenna, allowing for better lower band responses and symmetric patterns, while maintaining a small profile. These and other improvements are elucidated in the following description of the exemplary embodiments and Figures.

Figure 1:
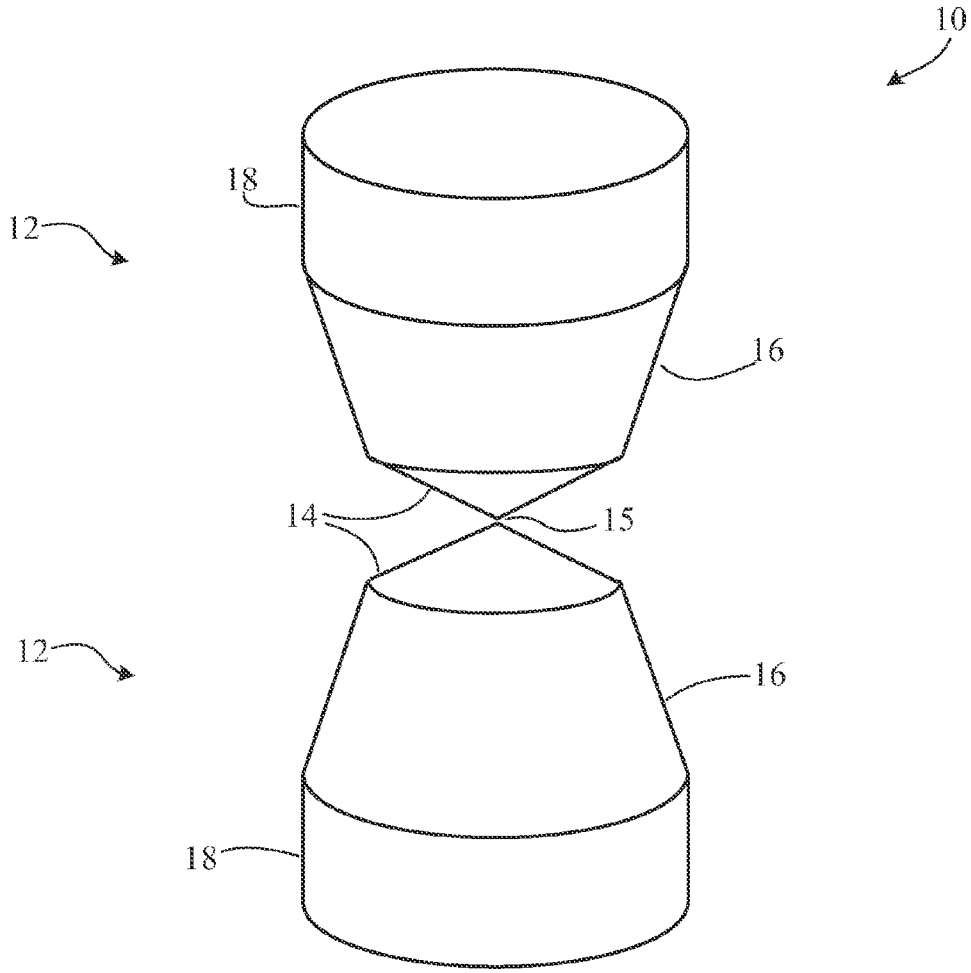
FIG. 1 shows a perspective view of a related art, biconical antenna.

FIG. 1 is a perspective illustration of a related art biconical antenna 10, which has limited broadband capabilities and whose pattern is principally omnidirectional. The biconical antenna 10 consists of an upper and lower set of conical shaped, radiating elements 12 having a plane of symmetry at midpoint 15. The radiating elements 12 are sectioned into three segments: a first conical segment 14, followed by a second (open) conical segment 16, and a third (open) conical segment 18.

By varying the elevation angles (e.g., angular widths) of the respective segments, the input impedance of the antenna 10 can be adjusted for radiation efficiency purposes. For example, it is known that a 50 ohm input impedance can be obtained for a biconical antenna if the radiating element(s) have angular widths that rise from the horizontal plane at approximately 23.2 degrees. Varying the elevation angles to devise a desired input impedance for conical antennas is a well known procedure and, therefore, the details thereof are left to one of ordinary skill in the art.

As a point of reference, the biconical antenna 10 of FIG. 1 is configured so that each conical segment 14, 16, 18 has angle of elevation variations from each other of approximately 30 degrees. For example, the surface of the first conical segment 14 is approximately 30 degrees from horizontal, the second conical segment 16 is approximately 60 degrees from horizontal, and the third conical segment 18 is approximately 90 degrees from horizontal. The "length" of each segment is proportioned according to the following relationship: first segment 14 length=second segment 16 length=d; third segment 18 length=0.7×d, where the length of each segment is measured parallel to the surface of the segment, at a constant azimuth. (Stated textually, the length of the third segment is seventy percent of the length of the first and second segments, which are equal in length.) The resulting biconical antenna 10 has an overall height of 12.60 inches with a maximum diameter of 8.34 inches. With these ratios maintained, the biconical antenna 10 can be physically scaled to accommodate lower or higher frequencies.

As with most antennas in general, one limitation of this related art antenna 10 is the degradation of its performance at low frequencies (i.e., long wavelengths) due to physical size conditions. As the wavelength increases (i.e., frequency decreases), the radiation efficiency decreases, causing the VSWR to increase. The VSWR can exceed a threshold value of 2 when the wavelength is approximately 3.553 times the overall length of the antenna. At lower frequencies, the gain of the antenna rapidly decreases and the VSWR rapidly increases. As is well known in the antenna arts, a high VSWR is indicative of an inefficient, poorly performing antenna. Good VSWR standards, for the purposes of this disclosure, are set to values of 2 or below over the frequency range of interest.

Figure 2:
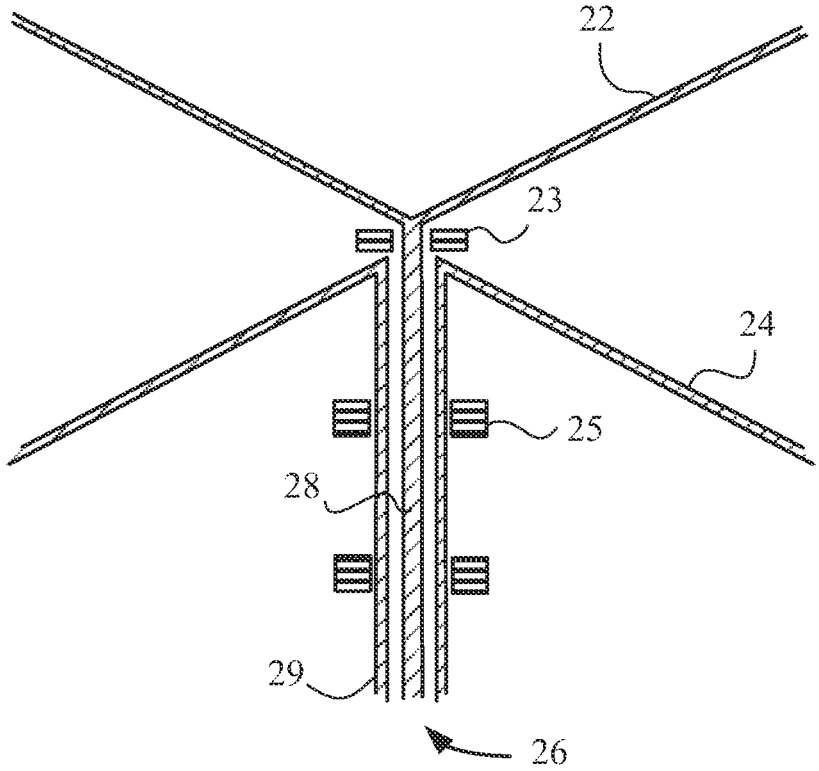
FIG. 2 is a cross-sectional illustration of an exemplary feed arrangement.

FIG. 2 is a cross-sectional illustration of an exemplary feed arrangement for a biconical antenna in accordance with the various embodiments described herein. The exemplary feed arrangement comprises an upper bicone section 22 and a lower bicone section 24, with a coaxial feed line 26 that leads through the center of one of the bicone sections (shown here as the lower bicone section 24). The coaxial feed line's center conductor 28 is joined to the apex of the upper bicone section 22 while the outer shield 29 is joined to the apex of the lower bicone section 24. Also illustrated in FIG. 2 are optional dielectric insulators 23 about the center conductor-to-upper bicone section junction; and optional loading ferrite beads or elements 25 along the coaxial feed line 26. In operation, the two opposing bicone section, in essence, form a diverging transmission line wherein RF energy flows outward from the feed point in a Transverse Electro-Magnetic (TEM) mode to launch energy into the air.

Figure 3A:
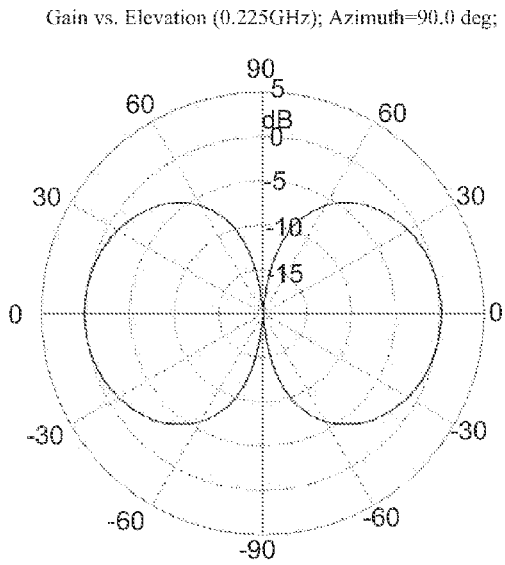
FIGS. 3A-D are computationally derived plots showing the performance of the antenna of FIG. 1.
Figure 3B:
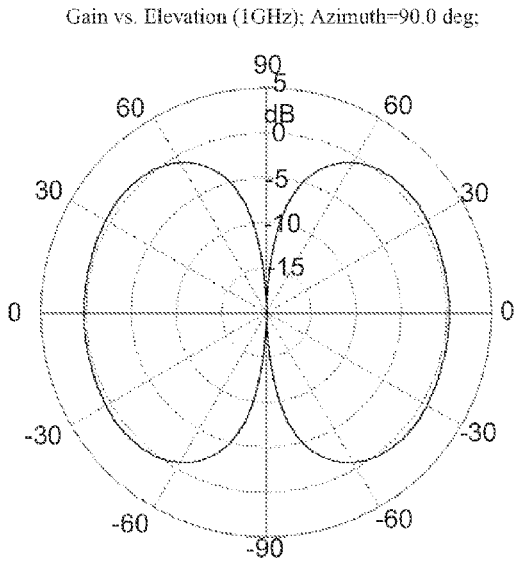
Figure 3C:
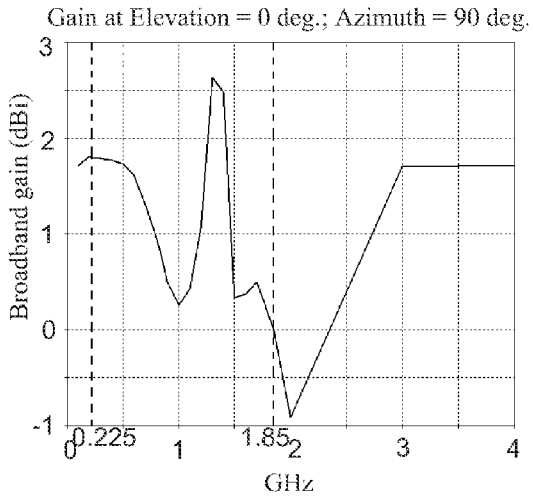
Figure 3D:
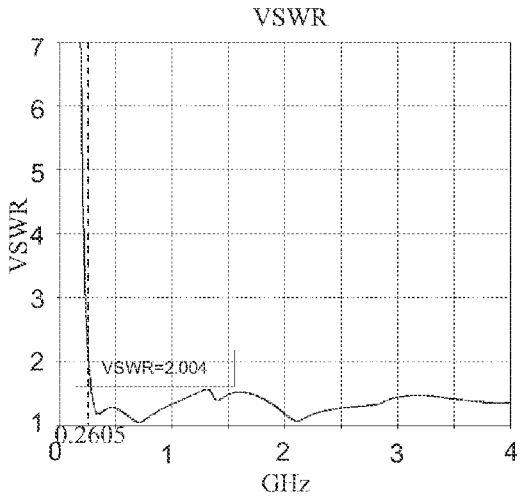

FIGS. 3A-D are computationally derived plots showing the performance of the related art bicone antenna 10 of FIG. 1. It is noted that FIGS. 3A-B show the traditional omnidirectional characteristics of the bicone antenna 10 while FIGS. 3C-D show the respective gain and VSWR responses. As can be seen in FIG. 3D, the response exceeds a VSWR value of 2.00 when operated below 260.5 MHz. Obviously, this antenna does not meet the above requirement of having a maximum VSWR of 2:1 from 225 MHz and higher.

One easy way to reduce the VSWR at these lower frequencies is to proportionally increase all of the dimensions of the bicone structure, as alluded to above. This approach preserves all of the advantageous characteristics of the antenna, including the isotropic patterns and 0 dBi gain at the horizon, however, it obviously does not produce the smallest possible antenna.

Accordingly, as described herein, numerous modifications to the general form of the biconical antenna 10 shown in FIG. 1 have been investigated in an attempt to design a compact, broadband, omnidirectional antenna with a minimum gain at the horizon of 0 dBi, and a maximum VSWR of 2:1 over a selected frequency range of 225 MHz to 1.85 GHz. The results of these design modifications have been tested by running simulations using CST MICROWAVE STUDIO® antenna modeling software by Computer Simulation Technology (CST) AG of Darmstadt, Germany.

Figure 4:
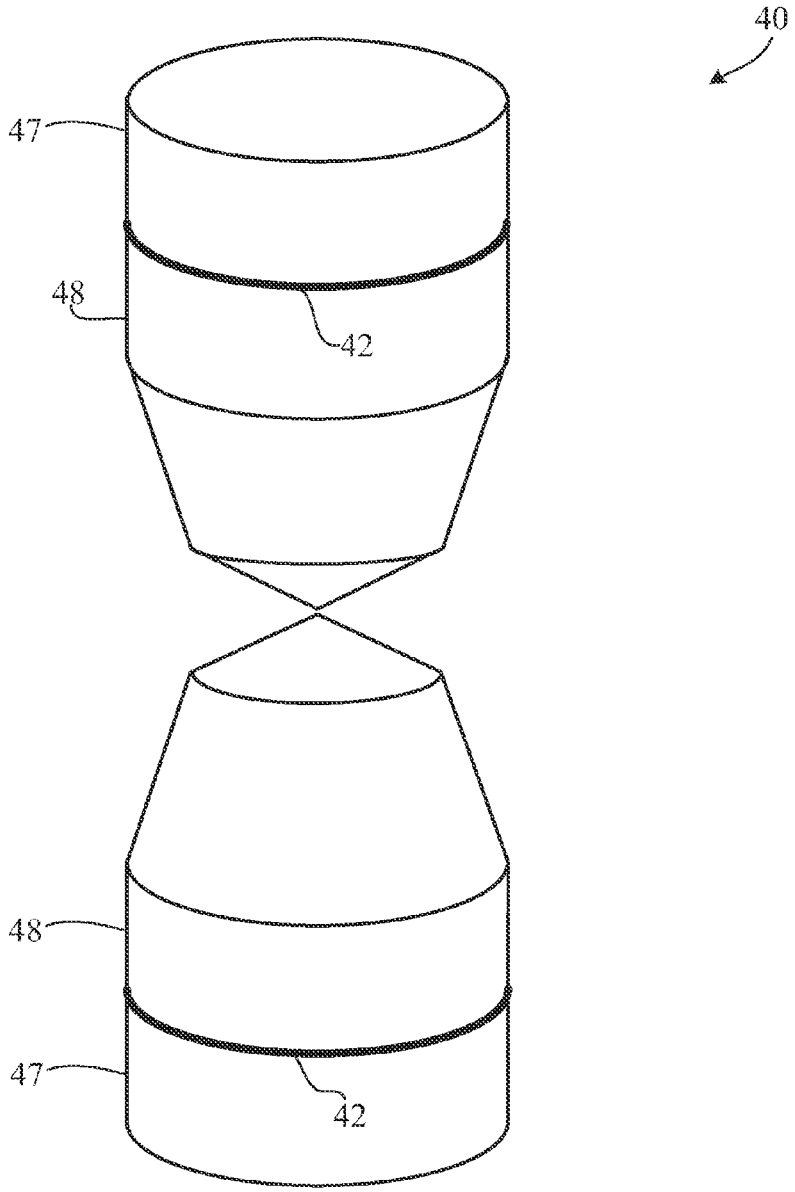
FIG. 4 shows a perspective view of an exemplary biconical antenna using metal extensions.

Several approaches to improving the low frequency end response of the related art biconical antenna 10 have been investigated. One exemplary embodiment 40 is shown in FIG. 4, where metal extensions 47 (i.e., fourth open conical segments) are appended to the last segments 48 of the biconical antenna 10 of FIG. 1, with seams 42 shown as bridging between segments 48 and metal extensions 47. The metal extensions 47 may be fabricated with lengths of approximately 1.50 inches, resulting in an overall height to the exemplary biconical antenna 40 of 15.60 inches, and a diameter of 8.34 inches. This exemplary embodiment 40 increases the maximum operating wavelength and results in a smaller structure than the alternative of up-scaling a version of the related art antenna 10 of FIG. 1. However, in attempting this modification, a consequence of not maintaining all of the proportions of the original biconical antenna 10 results in perturbations of the isotropic patterns over the entire frequency range. As shown in FIG. 5C, this modification disturbs the gain patterns at higher frequencies and causes nulls to form in the antenna patterns, reducing the gain at the horizon to below 0 dBi.

Figure 5A:
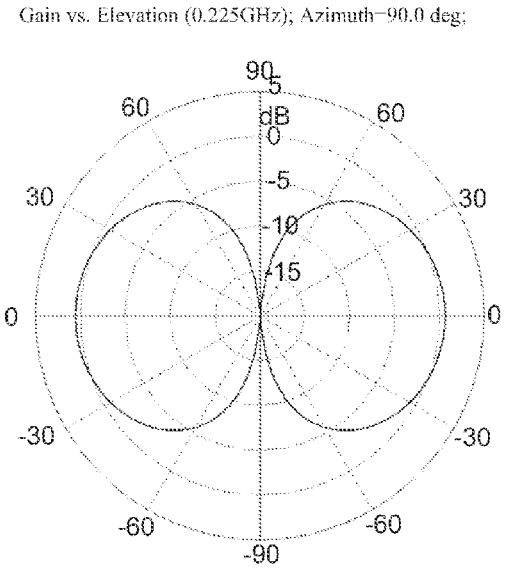
FIGS. 5A-D are computationally derived plots showing the performance of the exemplary biconical antenna of FIG. 4.
Figure 5B:
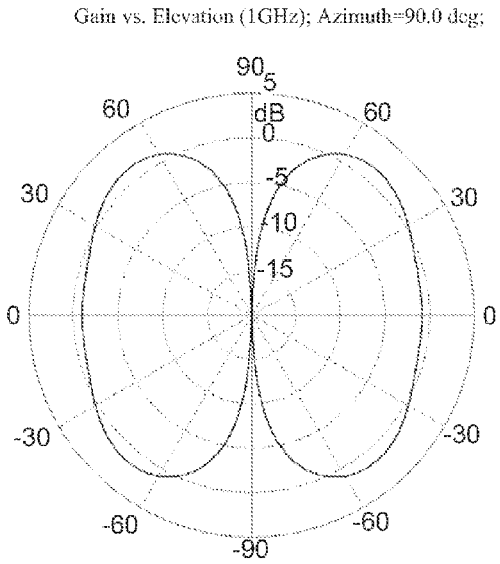
Figure 5C:
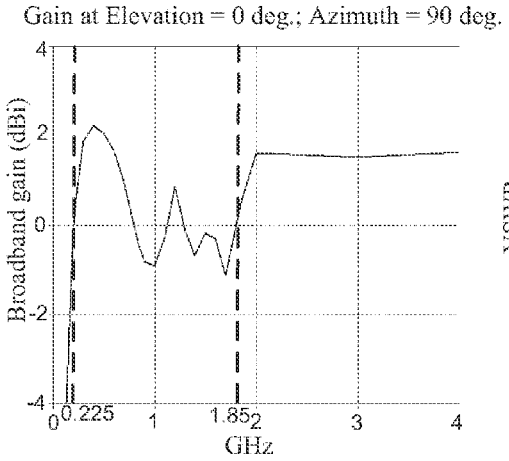
Figure 5D:
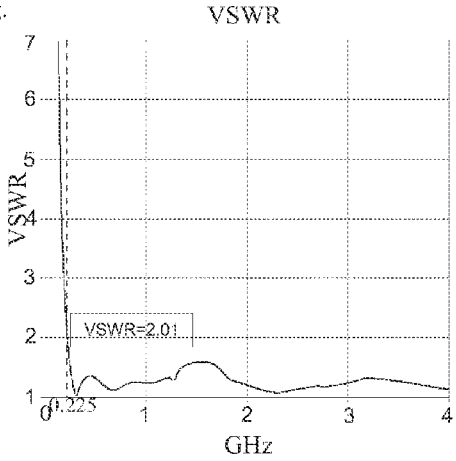

FIGS. 5A-D are computationally derived plots showing the performance of the exemplary antenna 40 of FIG. 4. In particular, FIGS. 5A-B show the elevation gain pattern characteristics of the exemplary antenna 40. FIGS. 5C-D show the respective gain and VSWR responses. As can be seen in FIG. 5D, the VSWR response is less than 2 down to 225 MHz, showing an improvement over the response of FIG. 3D. However, FIGS. 5B and 5C confirm that the antenna patterns develop splits at some frequencies, dropping below 0 dBi at the horizon at some frequencies between 225 MHz and 1.85 GHz.

Figure 6:
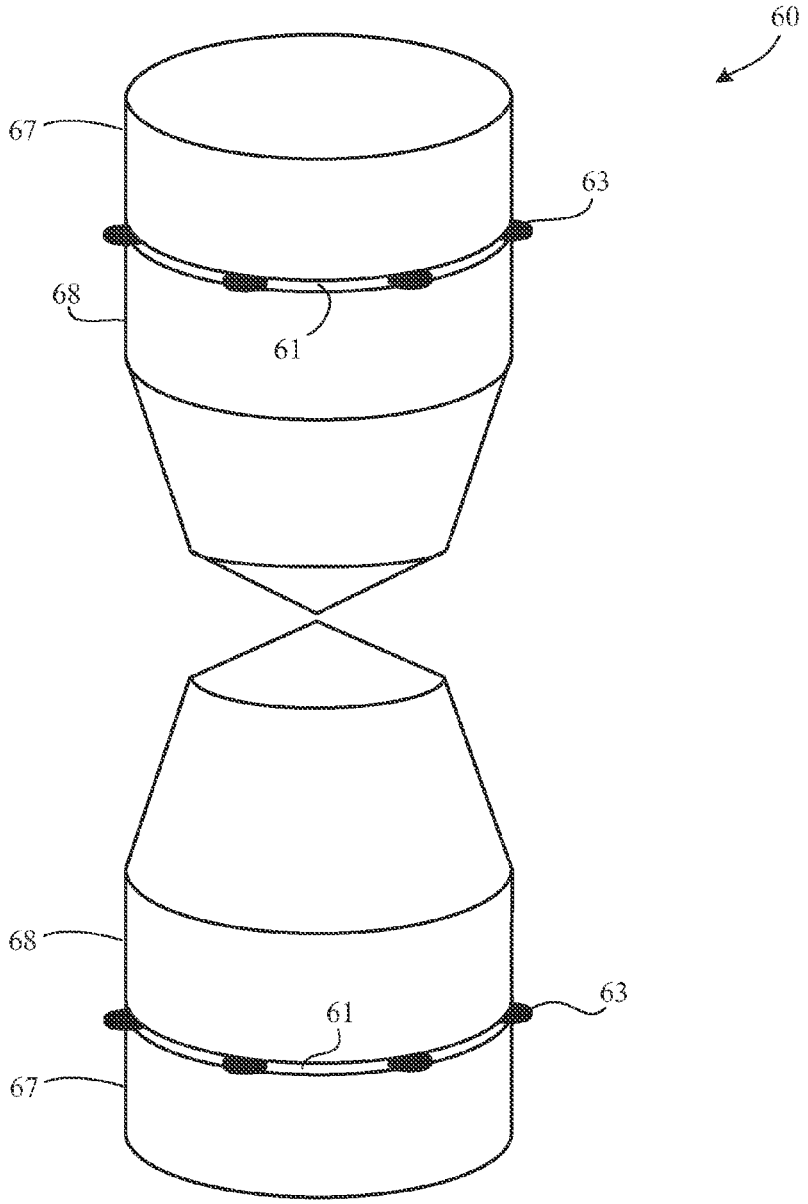
FIG. 6 shows a perspective view of another exemplary biconical antenna using metal extensions bridged with inductors.

Another exemplary embodiment 60 is shown in FIG. 6, where metal extensions 67 are coupled to the upper and lower segments 68 through inductors 63. Air gap 61 (or non-conducting gap) is seen between the metal extensions 67 and the segments 68. The principle behind this exemplary embodiment 60 is that the inductors 63, being low pass, frequency sensitive devices, allow the RF current to pass through them at lower frequencies into the extensions 67 where the extensions 67 are needed to improve the antenna gain and VSWR, but would block the flow of RF currents at higher frequencies so that the extensions 67 would not be able to disrupt the antenna patterns. This exemplary embodiment 60 was found to be more successful and improved upon the performance of the exemplary embodiment 40 of FIG. 4. However, it was found that an extra degree of care must be exercised to prevent resonances from occurring in the operating band. With this consideration, the exemplary embodiment 60 of FIG. 6 meets the performance criteria described above.

It should be appreciated that while FIG. 6 illustrates the inductors 63 as having a disc-like shape, other shapes, materials, types, connection arrangements, and so forth can be utilized without departing from the spirit and scope of this disclosure. As examples of alternate forms, the inductors 67 can be in the form of wires, wires with ferrite beads, coils, meandering wires, etc.

Figure 7:
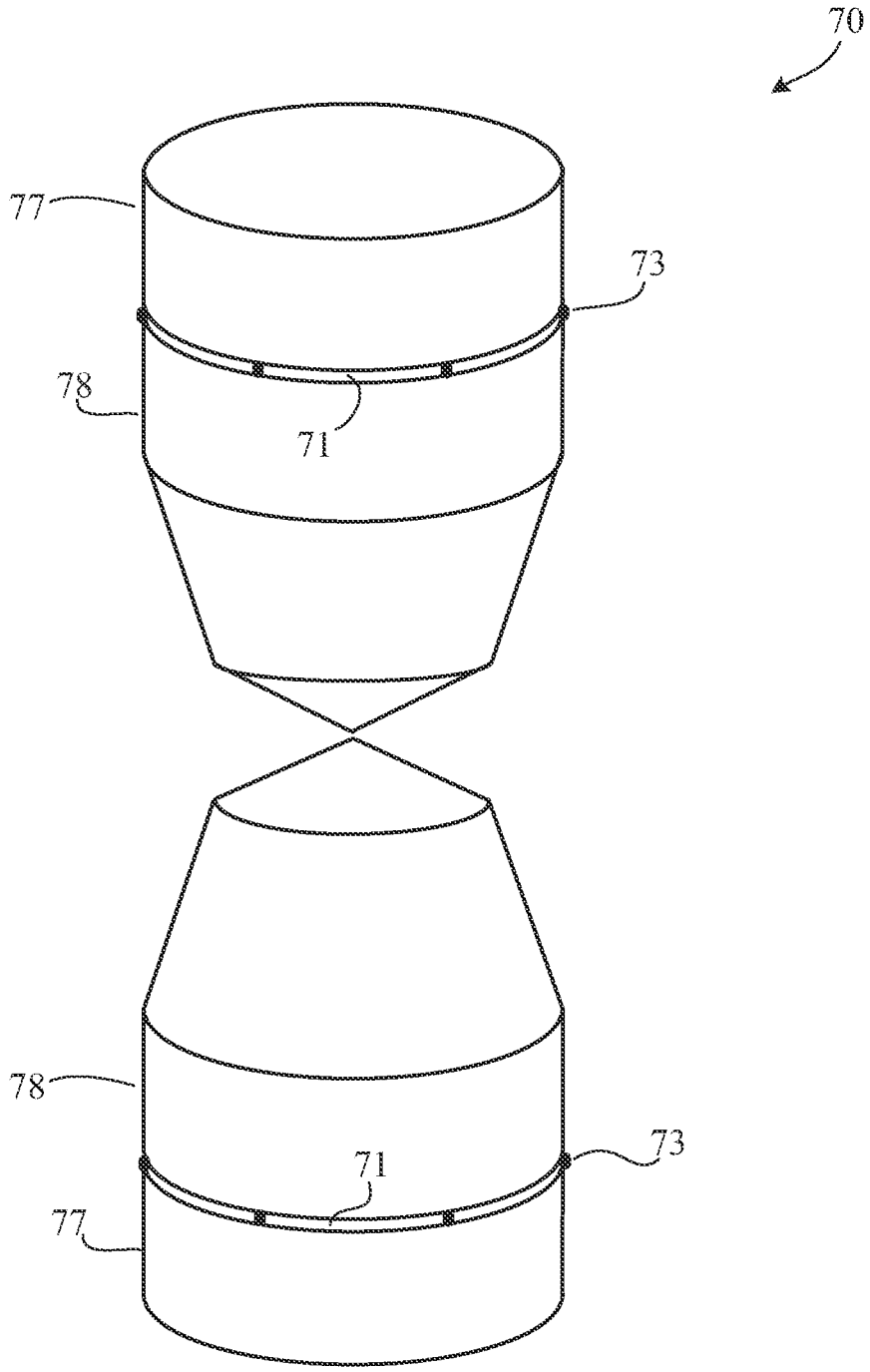
FIG. 7 shows a perspective view of another exemplary biconical antenna using metal extensions bridged with resistors.

Another exemplary embodiment 70 is shown in FIG. 7, where metal extensions 77 are coupled to the upper and lower segments 78 through discrete resistors 73 across gap 71. Simulation runs on this design demonstrated some level of improvement in performance over the exemplary antenna 40 of FIG. 4.

Figure 8:
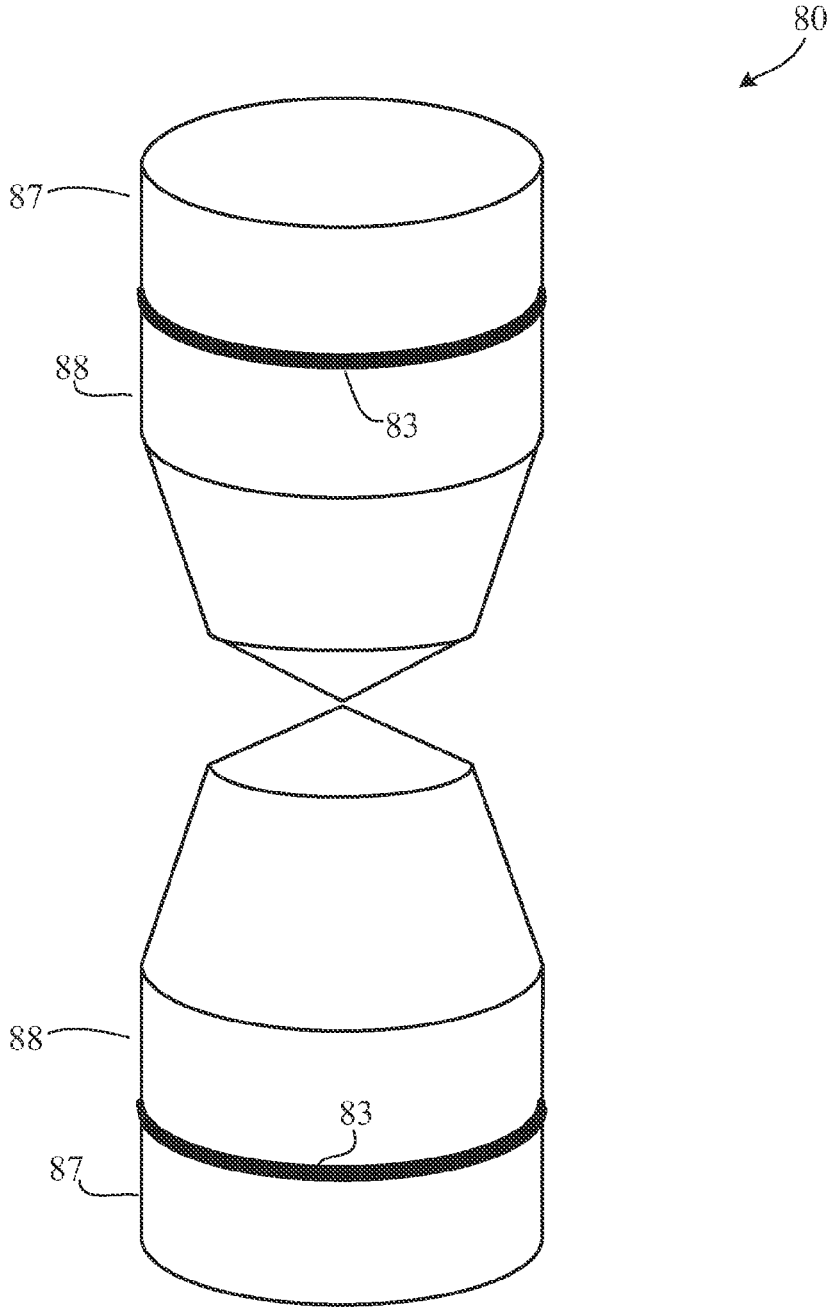
FIG. 8 shows a perspective view of another exemplary biconical antenna using metal extensions bridged with a resistive film.

A modification of the exemplary embodiment 70 of FIG. 7 is shown in FIG. 8, where gap 71 and discrete resistors 73 of FIG. 7 are replaced with a section of resistive film 83. Thus, the section of resistive film 83 acts as a "continuous" bridge between lower segments 88 and metal extensions 87. Simulation runs on this design demonstrated some level of improvement in performance over the exemplary antenna 40 of FIG. 4.

Figure 9:
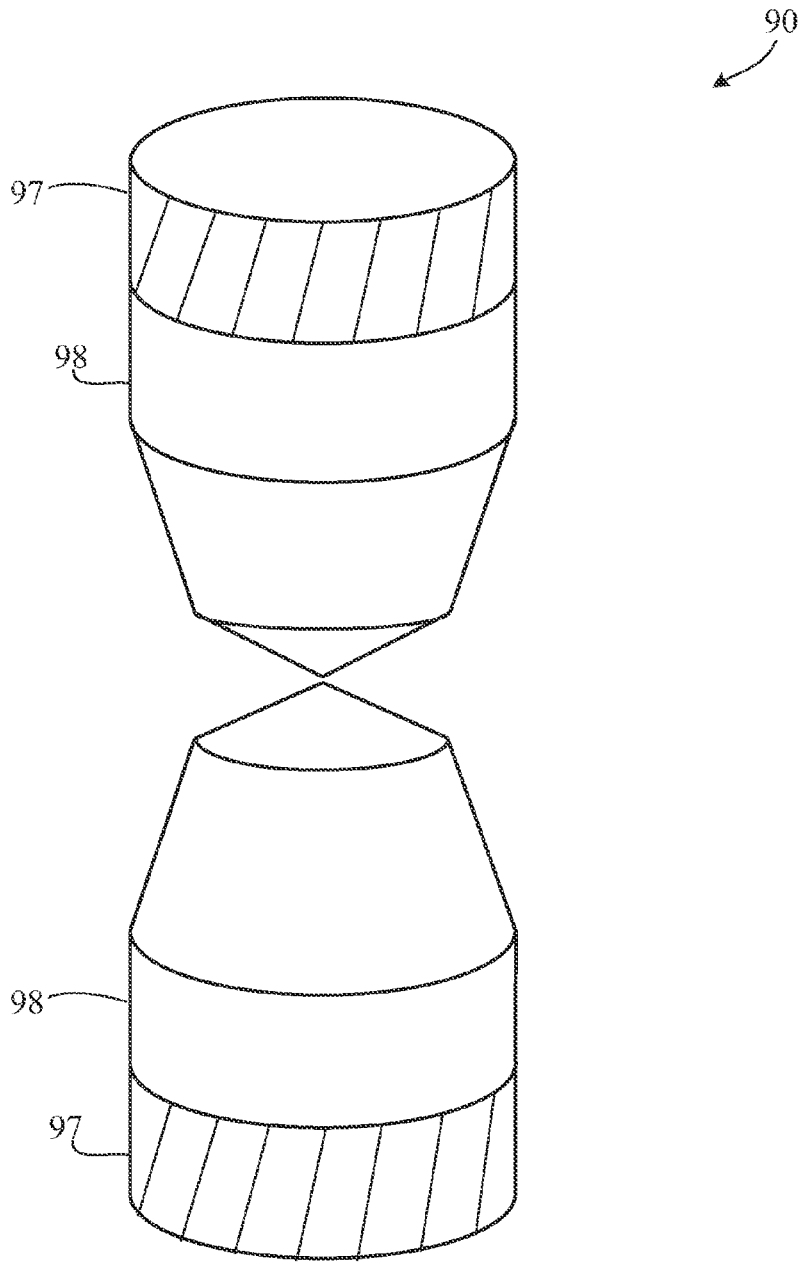
FIG. 9 shows a perspective view of another exemplary biconical antenna where the extensions are formed of a resistive film.

A modification of the exemplary embodiment 80 of FIG. 8 is shown in FIG. 9, where the segment of resistive film 83 and metal extension 87 of FIG. 8 are replaced with a resistive film 97 alone. This exemplary embodiment 90 does not include the metal extensions of the previous embodiments and was selected due to the relative ease of construction. Additional computer analysis showed that the optimum resistivity of the film was 600 ohms per square, for the example considered here.

The extensions made entirely of resistive film 97 operate to improve the performance and reduce the VSWR at low frequencies by acting as conductive extensions, increasing the length of the antenna. Computer analyses have shown that the resistive film 97 absorbs only a very small part of the RF energy, and that most of the RF energy is radiated. Additional computer analyses have also shown that the resistive approaches shown in FIGS. 7-8 operate to prevent the formation of higher frequency nulls in the antenna patterns by creating partial reflections of the waves at the boundaries between the original metal bicone structure and the resistive elements. These partial reflections help to cancel out the waves reflected from the outer ends of the reflective elements, thus disrupting the standing wave patterns of the currents on the bicones and minimizing the formation of nulls in the antenna patterns.

Figure 10A:
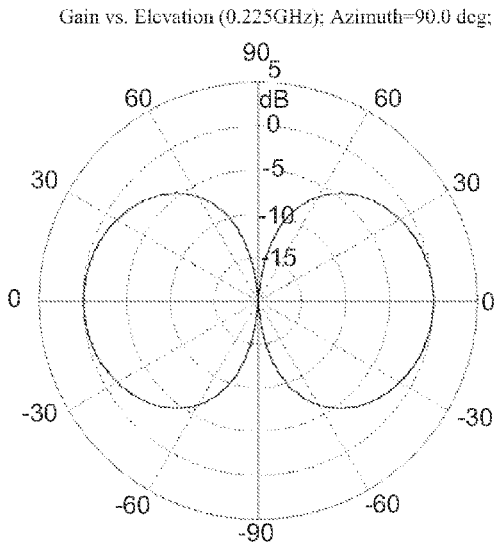
FIGS. 10A-D are computationally derived plots showing the performance of the exemplary biconical antenna of FIG. 9.
Figure 10B:
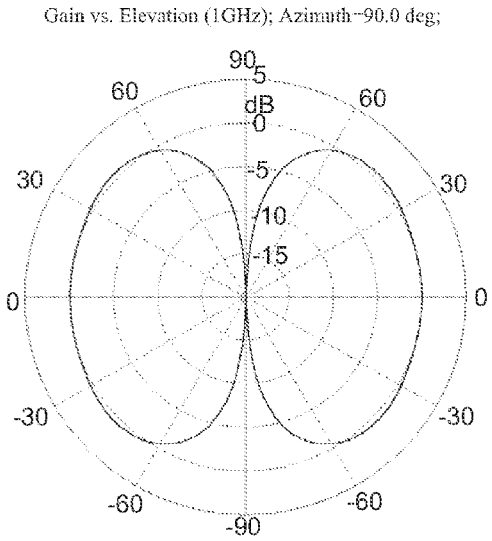
Figure 10C:
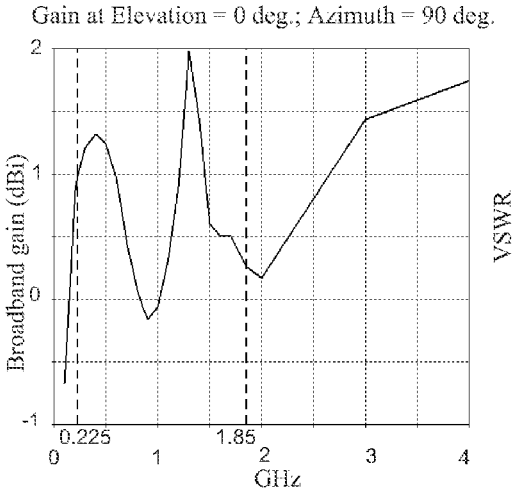
Figure 10D:
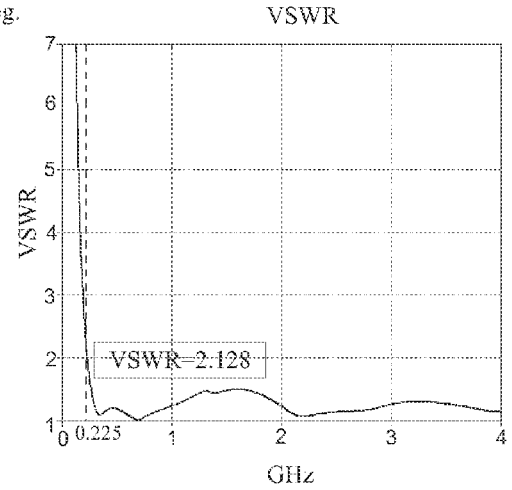

FIGS. 10A-D are computationally derived plots showing the performance of the exemplary antenna 90 of FIG. 9. The antenna gain patterns plotted in FIGS. 10A-B illustrate the nearly split-free elevation gain patterns and FIG. 10C illustrates the ability to achieve a gain of above 0 dBi at the horizon for all frequencies in the 225 MHz to 1.85 GHz operating range. FIG. 10D illustrates the ability of the exemplary embodiment 90 to achieve a VSWR of 2 or less down to the minimum operating frequency of 225 MHz. It should be noted that prototypes of this exemplary embodiment 90 were constructed and tested, with the experimental results agreeing closely with the data plotted above.

Figure 11:
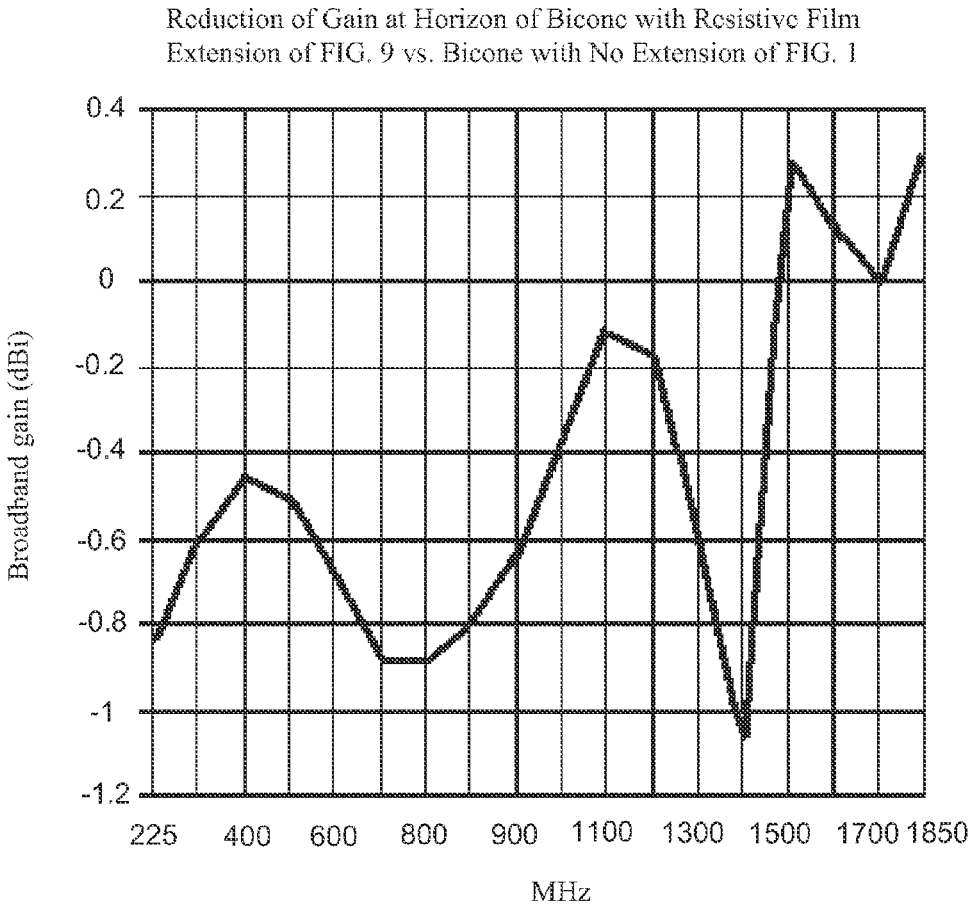
FIG. 11 is a plot comparing the gain of the bicone of FIG. 9 versus the bicone of FIG. 1.

FIG. 11 is a plot comparing the gain of the resistive film extension bicone 90 of FIG. 9 versus the related art bicone with no extension 10 of FIG. 1. FIG. 11 shows that although the addition of the resistive film extension 97 reduces the gain at the horizon by a small amount, on the order of 0.6 dB, the gain at the horizon remains above the required value of 0 dBi, as shown in FIG. 10C.

Figure 12:
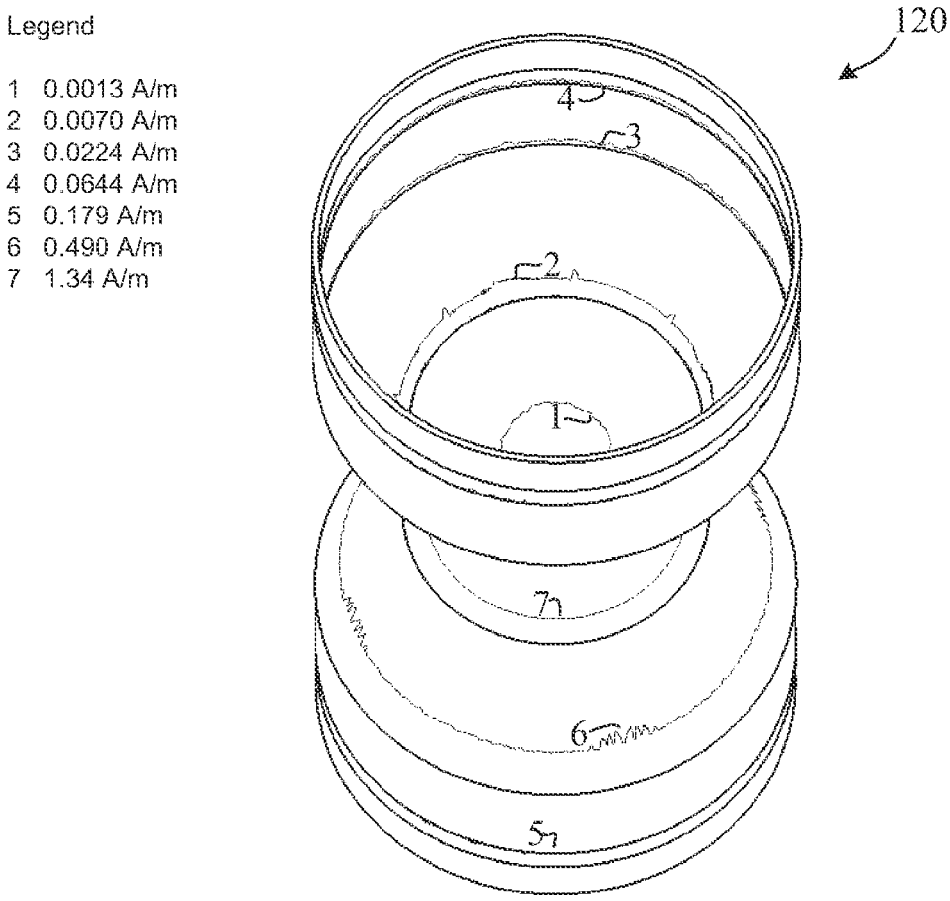
FIG. 12 is a contour plot of the current density along the surface the bicone of FIG. 9 at a frequency of 1 GHz.

FIG. 12 is a contour plot 120 showing the current density distribution along the surface of the resistive film extension bicone 90 of FIG. 9 at a frequency of 1 GHz. It shows the axial symmetry of the current density around the bicone 90, as well as the variation of the current amplitude along the vertical axis of the bicone 90.

An additional capability of the bicone antenna 90 with resistive film extensions of FIG. 9 is its ability to act as a balun, in that it will minimize RF currents flowing on the outer surface of the coaxial feed line. This ability is illustrated in the RF current contour plot of FIG. 12, which shows that currents on the surface of the bicone where the feed line is connected are very small, resulting in correspondingly small currents on the outside of the feed line. If needed, the currents can be further reduced through the addition of ferrite beads, as shown in FIG. 2.

In summary, these results demonstrate the ability to improve upon the related art capabilities of biconical antennas with the use of extensions, particularly, resistive film extensions to extend the operation to longer wavelengths at the lower end of the frequency range. As a point of reference, the exemplary embodiment 80 has an overall height of 15.60 inches and a diameter of 8.34 inches. In contrast, an equivalently performing bicone antenna scaled-up from the bicone antenna 10 of FIG. 1 would have an overall height of 16.00 inches and a diameter of 10.60 inches. The exemplary embodiments represent a significant decrease in size while obtaining the performance capabilities of a larger antenna.

Based on the above results, a compact broadband antenna capable of operating within 225 MHz to 1.85 GHz while maintaining an omnidirectional pattern has been demonstrated. However, it is well understood that specified frequency range devices such as the antennas described herein can be modified for different frequency ranges by adjustment of the respective antenna dimensions. Accordingly, while the exemplary embodiments described herein are detailed in the context of operating between 225 MHz to 1.85 GHz, different frequency ranges can be achieved by suitable modification as according to the knowledge of one of ordinary skill in the antenna arts.

It should be appreciated to one of ordinary skill in the art that a bicone antenna is a symmetric structure and, accordingly, with the use of a ground plane can be truncated into a monocone structure, the resulting modification causing fields to double their gain and only be present in a single hemisphere rather than in both hemispheres. Therefore, modifications and changes to the exemplary embodiments described above may be made by one of ordinary skill in the art without departing from the spirit and scope of this disclosure.

It is also understood that antennas are reciprocal devices, capable of transmitting radio signals as well as receiving radio signals. Therefore, while the FIGS. of the exemplary embodiments do not illustrate a transmitter or receiver, such devices and systems are implicit for the operation of an antenna. Additionally, while the term "radio" is used to signify a particular type of electromagnetic radiation, it is understood that it is not limited to a specific frequency range, as in the classic context. Due to scalability of the exemplary antenna, the term radio is generically used to describe time-harmonic electromagnetic signals.

As is apparent, it will be understood that many additional changes in the details, materials, steps and arrangement of parts, which have been herein described and illustrated to explain the nature of the invention, may be made by those skilled in the art within the principal and scope of the invention as expressed in the appended claims.

What is claimed is:

1. A compact, omnidirectional, broadband antenna with a VSWR of 2:1 or less over its design frequency range, comprising:

a first conical metal segment having its tip coincident with a horizontal plane, with an elevation angle between 23 degrees and 30 degrees from the horizontal plane;

an open second conical metal segment joined to a distal end of the first conical metal segment, with an elevation angle approximately 30 degrees greater than the elevation angle of the first conical metal segment;

an open third conical metal segment joined to a distal end of the open second conical metal segment, with an elevation angle approximately 30 degrees greater than the elevation angle of the open second conical metal segment;

at least one of a plurality of inductors or resistors, or a resistive film joined to a distal end of the open third conical metal segment;

an open fourth conical metal segment joined to a distal end of the plurality of inductors or resistors, or resistive film, with an elevation angle approximately equal to the elevation angle of the open third conical metal segment angle, wherein the first, second, third, and fourth conical metal segments are mirrored to form a biconical antenna; and a transmission line coupled to the tip of the first conical metal segment, interior to the first conical metal segment.

2. The antenna of claim 1, wherein the frequency range of operation of the biconical antenna is between 225 MHz and 1.85 GHz.

3. The antenna of claim 2, wherein a height of the antenna is less than 15.9 inches and a diameter of the antenna is less than 10 inches.

4. The antenna of claim 3, wherein a length of the first and second conical metal segments are equal and a length of the third conical metal segment is approximately seventy percent of the length of the first and the second segments.

5. The antenna of claim 1, wherein the open fourth conical metal segment is approximately 1.5 inches in length.

6. The antenna of claim 1, further comprising ferrite beads disposed about the transmission line.

7. The antenna of claim 6, wherein the frequency range of operation of the biconical antenna is between 225 MHz and 1.85 GHz.

8. The antenna of claim 7, wherein a length of the first and second conical metal segments are equal and a length of the third conical metal segment is approximately seventy percent of the length of the first and the second segments.

9. A compact, omnidirectional, broadband antenna with a VSWR of 2:1 or less over its design frequency range, comprising:

a first conical metal segment having its tip coincident with a horizontal plane, with an elevation angle between 23 degrees and 30 degrees from the horizontal plane;

an open second conical metal segment joined to a distal end of the first conical metal segment, with an elevation angle approximately 30 degrees greater than the elevation angle of the first conical metal segment;

an open third conical metal segment joined to a distal end of the open second conical metal segment, with an elevation angle approximately 30 degrees greater than the elevation angle of the open second conical metal segment;

an open fourth conical resistive film segment joined to a distal end of the open third conical metal segment, with an elevation angle approximately equal to the elevation angle of the open third conical metal segment, wherein the first, second, third, and fourth conical metal segments are mirrored to form a biconical antenna; and a transmission line coupled to the tip of the first conical metal segment, interior to the first conical metal segment.

10. The antenna of claim 9, wherein a height of the antenna is less than 15.9 inches and a diameter of the antenna is less than 10 inches.

11. The antenna of claim 9, wherein the open fourth resistive film segment is approximately 1.5 inches in length.

12. The antenna of claim 9, wherein the resistive film has a resistance per square of approximately 600 ohms.

13. The antenna of claim 9, further comprising ferrite beads disposed about the transmission line.

14. A method for radiating/receiving in an omnidirectional direction over a frequency range, with a VSWR of 2:1 or less, comprising:

forming a first conical metal segment with its tip coincident with a horizontal plane, having an elevation angle between 22 degrees and 30 degrees from the horizontal plane;

joining an open second conical metal segment to a distal end of the first conical metal segment, with an elevation angle approximately 30 degrees greater than the elevation angle of the first conical metal segment;

joining an open third conical metal segment to a distal end of the open second conical metal segment, with an elevation angle approximately 30 degrees greater than the elevation angle of the open second conical metal segment;

joining an open fourth conical resistive film segment to a distal end of the open third conical metal segment, with an elevation angle approximately equal to the elevation angle of the open third conical metal segment; and mirroring the first, second, third, and fourth conical metal segments to form a biconical antenna; and coupling a transmission line to the tip of the first conical metal segment, interior to the first conical metal segment; and at least one of receiving or transmitting electrical signals via the transmission line.

* * * * *